United States Patent [19]

Yeager et al.

[11] 3,932,013

[45] Jan. 13, 1976

[54] SHUNT ASSEMBLY

[75] Inventors: Marvin Leo Yeager; Homer Ernst Henschen, both of Carlisle, Pa.

[73] Assignee: AMP Incorporated, Harrisburg, Pa.

[22] Filed: Apr. 8, 1974

[21] Appl. No.: 458,915

[52] U.S. Cl. ..... 339/19; 339/217 S
[51] Int. Cl.[2] ..... H01R 9/12; H01R 31/08
[58] Field of Search ..... 339/19, 22 B, 217 S

[56] References Cited

UNITED STATES PATENTS

| | | | |
|---|---|---|---|
| 3,456,231 | 7/1969 | Paullus et al. | 339/19 UX |
| 3,486,160 | 12/1969 | Wallace, Jr. | 339/19 UX |
| 3,544,954 | 12/1970 | Yeager | 339/217 S |
| 3,594,714 | 7/1971 | Paullus et al. | 339/19 UX |
| 3,609,640 | 9/1971 | Longenecker et al. | 339/217 S |
| 3,789,343 | 1/1974 | Hirokawa et al. | 339/217 S |

*Primary Examiner*—Joseph H. McGlynn
*Assistant Examiner*—Howard N. Goldberg
*Attorney, Agent, or Firm*—Russell J. Egan, Esq.

[57] ABSTRACT

A shunt assembly is disclosed for interconnecting closely spaced terminal contacts. The contacts of the subject shunt are strip formed in a conventional fashion with a shunting bar interconnecting adjacent pairs of contacts. The required number of contacts are cut from the carrier strip and the interconnecting shunting bars are bent to a folded configuration thereby drawing the contacts closer together to achieve the desired spacing. The closely spaced contacts can be inserted into an appropriate housing of insulating material if so desired.

2 Claims, 5 Drawing Figures

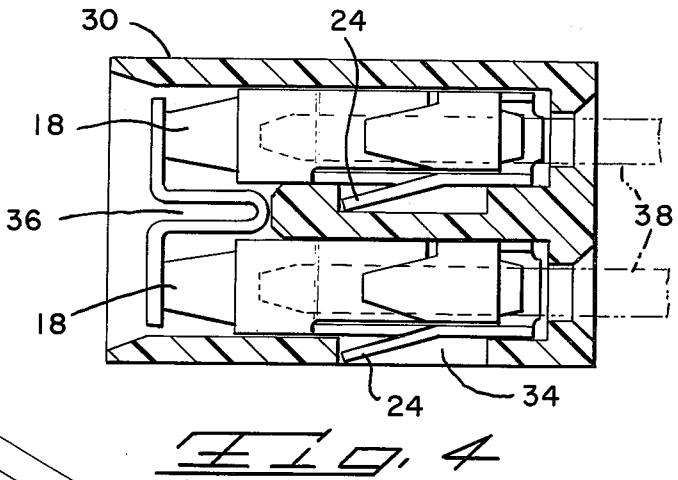
FIG. 4
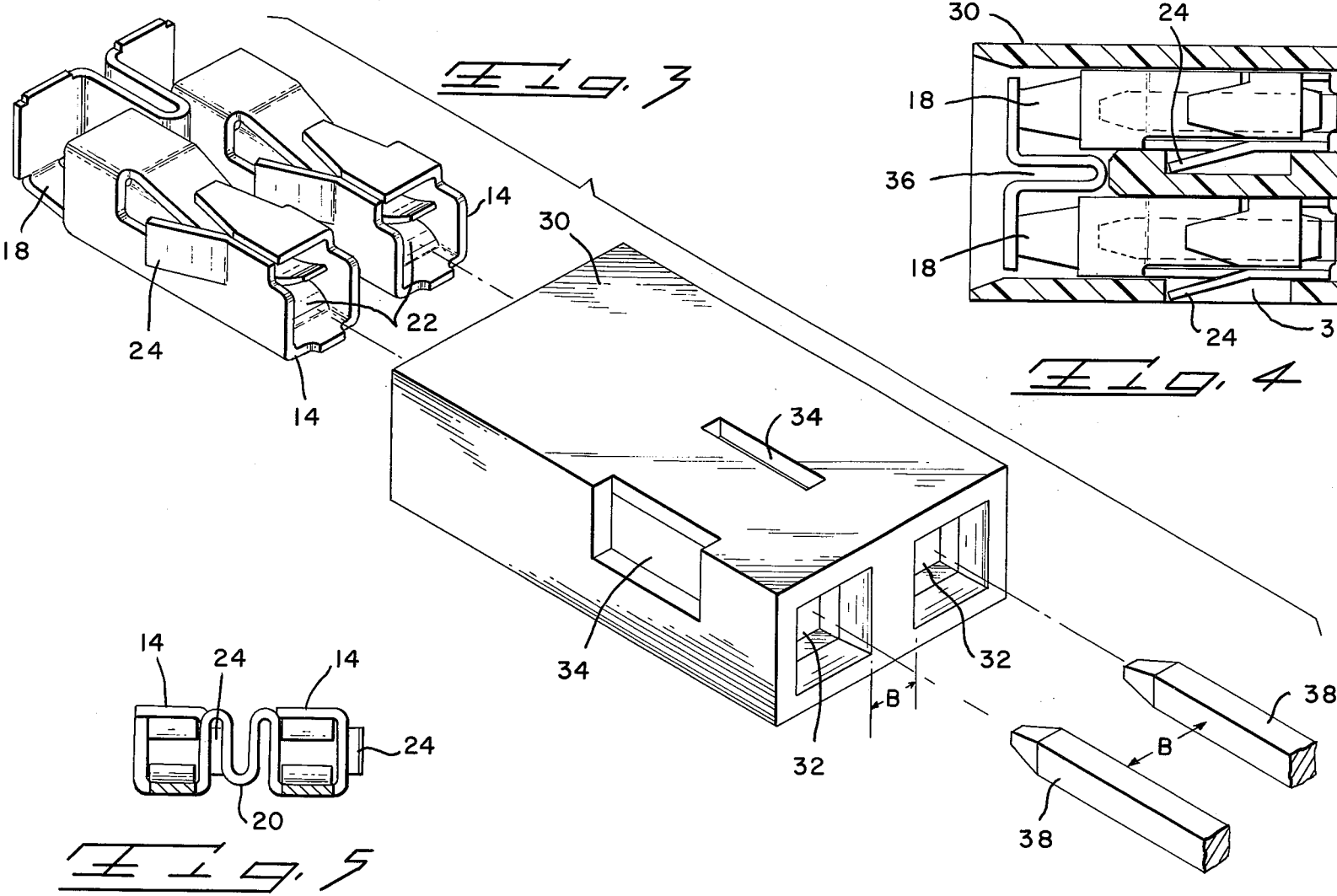
FIG. 3
FIG. 5

SHUNT ASSEMBLY

BACKGROUND OF THE INVENTION

1. The Field Of The Invention

The present invention relates to a shunt assembly and in particular to a shunt assembly having closely spaced contacts.

2. The Prior Art

Terminal junction or shunt systems are well known in the electrical and electronic arts since it is frequently necessary to temporarily interconnect two or more adjacent terminals. Terminal junction wiring systems generally employ single or multiple modules in the form of a housing of rigid insulating material, conventionally of rectangular configuration, incorporating means for physically mounting the housing in a support and wherein a plurality of such housings may be mounted in side by side fashion depending upon the number of electrical interconnections being made. Each housing is provided with a plurality of contact receiving cavities which extend in parallel spaced fashion within the housing and extend inwardly from an open side thereof. Conventionally a cluster of closely spaced and aligned electrical contacts are supported in a common manner by a metallic bus strip. The cluster of contacts is inserted into the respective contact receiving cavities or passageways and means are provided for preventing extraction of the bus strip and cluster of contacts from the housing. The terminal junction assembly is then mated with appropriate contacts in conventional fashion. In order to maintain engagement between the mated contacts conventionally the mutually interengageable contacts include retention means resisting withdrawal or rectrograve movement of the contacts. These shunt systems usually have the disadvantage of being rather large and bulky.

Another known shunting arrangement is the use of a patch cord system having terminals formed on either end of a short strip of flexible conductor. Each end of the patch cord is appropriately connected to the terminals to be shunted. A problem arises in using this type of shunt when the terminals to be shunted are in very closely spaced relationship, which frequently occurs on multi-terminal boards.

There have been attempts made to provide shunt devices with closely spaced contacts. However, each of these has encountered the problem of forming a contact from a continuous strip and yet have the contacts sufficiently closely spaced together. In any blanking operation the contacts necessarily have to be spaced apart a certain distance in order to provide sufficient material for forming the contact. Any bus bar formed with the contacts must be of either sufficient length to bridge the gap formed between contacts during blanking or the contacts must be individually formed, separated from a carrier strip, spaced closely together and then attached by some means, such as welding, to a busing strip with the contacts in a closely spaced relation. Such a shunting arrangement would, of course, have the disadvantage of requiring the extra steps of separating and then rejoining the contacts in the closely spaced relationship.

There have also been suggestions for folding or bending a bus strip interconnecting adjacent terminals. For example U.S. Pat. Nos. 3,345,599; 3,456,231; 3,594,714; all show terminal junctions having commoning strips which are bent to some configuration to provide close spacing between the contacts attached thereto.

SUMMARY OF THE PRESENT INVENTION

The present invention concerns a shunt assembly and includes at least two electrical contacts interconnected by an integral bus bar with the bus bar being bent to assume a predetermined configuration which causes the contacts to be drawn together to a closely spaced configuration. The contacts with the folded bus bar can be inserted into an appropriate housing of insulating material.

It is therefore an object of the present invention to produce a shunt assembly in which at least two contacts are integrally formed with a common bus bar and closely spaced together by folding the common bus bar.

It is another object of the present invention to produce a shunt assembly having a plurality of contacts integrally formed from a continuous strip of material, interconnected by a common bus bar, with the bus bar being folded upon itself to bring adjacent contacts sufficiently close together to be mated with closely spaced terminal pins.

It is still another object of the present invention to produce a shunt assembly having at least two contacts joined by an integral bus bar, which is folded upon itself to bring the contacts into a closely spaced configuration, and a housing of insulating material having at least two closely spaced contact receiving cavities.

It is a further object of the present invention to produce a shunt assembly which can be readily and economically manufactured.

The means for accomplishing the foregoing objects and other advantages will become apparent from the following detailed description taken with reference to the accompanying drawings.

BRIEF DESCRIPTION OF THE DRAWINGS

FIG. 3 is an exploded perspective view of the pair of contacts shown in FIG. 2, with the bus bar portion folded 90° to align the loop parallel to the axis of the contacts, a housing and a pair of terminal pins;

FIG. 4 is a transverse longitudinal through the subject shunt assembly; and

FIG. 5 is a rear elevation showing an alternate configuration for bending the commoning bus bar.

DETAILED DESCRIPTION OF THE PREFERRED EMBODIMENT

The contact portion of the subject shunt assembly is stamped and formed from a continuous strip of conductive material according to conventional methods. However, because of the fact that a certain amount of material is required to form any electrical contact, the individual contacts must be formed on the strip spaced apart a fixed distance A. This distance frequently is far greater than the spacing between adjacent terminals on a terminal strip. Thus it is necessary to form the subject contact portion in such a manner that the spacing between adjacent contacts can be reduced to a smaller distance B.

Figure 1:
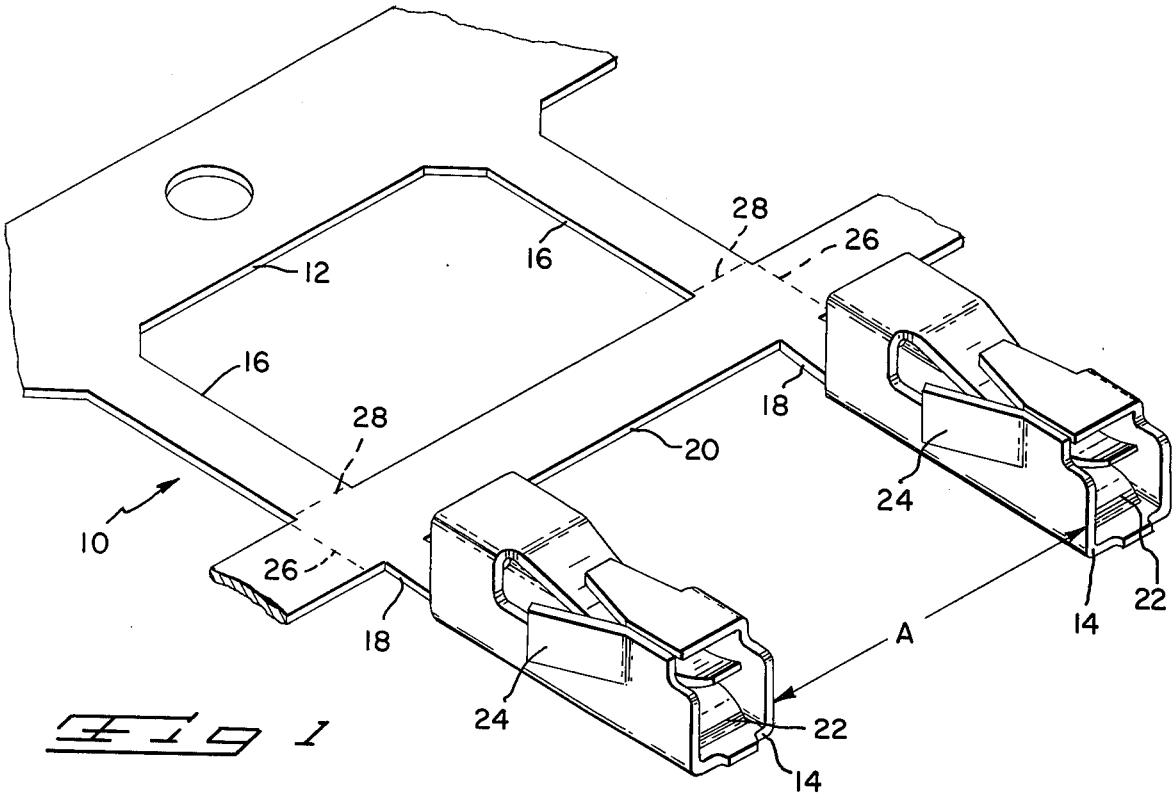
FIG. 1 is a perspective view of a strip of female electrical receptacle contacts formed in accordance with the present invention.

FIG. 1 shows a fragment of a strip of contacts 10 for the subject shunt assembly. The strip includes a carrier strip 12, contacts 14 integrally formed on the free ends of connecting tabs 16 and 18 and interconnected by an integral bus bar 20. The contacts, shown by way of example, are female receptacle contacts having pin receiving cavities 22 and locking lances 24. It is to be understood that any configuration of electrical contact can be substituted for the ones shown. The strip 10 can be formed in a great length and a cluster of at least two contacts 14 separated therefrom by severing along lines 26 and 28.

The housing 30 is formed of insulating material and includes at least two closely spaced, parallel contact receiving cavities 32. A locking lance receiving aperture 34 is formed in at least one side wall of each cavity 32 and a recess 36 joins one end of adjacent cavities. The cavities are spaced apart a distance B, which equals the spacing between adjacent fixed terminals 38.

Figure 2:
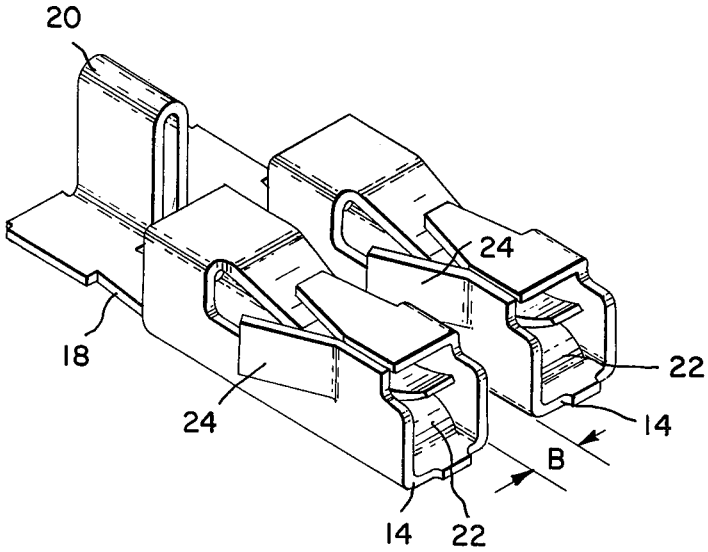
FIG. 2 is a perspective view of a pair of the contacts of FIG. 1 with the integral bus bar therebetween bent in a single loop.

The contacts 14, only two of which are illustrated for sake of convenience, are severed from the carrier strip along lines 26 and 28 and the common bus bar 20 is bent to draw the contacts to a closely spaced, parallel configuration. FIG. 2 shows the bus bar 20 with a single loop formed therein extending normal to the plane of the bus bar. In FIGS. 3 and 4, the loop has been further folded at approximately right angles to extend parallel to and intermediate of adjacent contacts 14. It is to be understood that this sequence of folding can be reversed if so desired.

The contact cluster with the folded bus bar can be inserted into housing 30, since the contacts 14 are now spaced apart a distance equal to the spacing of cavities 32. The locking lances 24 engage in apertures 34 to secure the contacts in the housing. In instances when it is not necessary to insulate the closely spaced shunt contacts, the housing can be omitted.

FIG. 5 shows an alternate fold configuration for the common bus bar. In this instance the bus bar has been bent in multiple loops to approximate the letter M. This configuration may be particularly useful when the contacts are formed with an initial wide spacing. The M shaped bend can also be folded to lie between the contacts should the height of the loops exceed the height of the individual contacts.

The present invention may be subject to many modifications and changes without departing from the spirit or essential characteristics thereof. The present embodiments are therefore to be considered in all respects as illustrative and not restrictive.

What is claimed is:

1. A shunt assembly comprising:

a housing having a plurality of closely spaced passageways therein and a recess between adjacent passageways;

a contact array including a plurality of electrical contacts and an integral common bus bar interconnecting adjacent contacts, said contact array being stamped and formed from a single continuous strip of conductive material with said contacts extending normal to the plane of said bus bar, said bus bar having at least one fold formed therein, said at least one bus bar fold comprising at least one fold extending normal to the plane of said bus bar and parallel to the axes of said contacts so as to lie between adjacent pairs of contacts and within the overall length thereof, and extending into said recess, whereby said contacts assume a closely spaced parallel arrangement and are received in said passageways with said folded bus bar lying in said recesses.

2. A shunt assembly according to claim 1 further comprising a locking lance on each said contact and a mating locking lance receiving cavity in each said passageway, said locking lances engaging in said cavities whereby said contact array is locked in said housing.

* * * * *